United States Patent [19]

Barter

[11] Patent Number: 4,511,195

[45] Date of Patent: Apr. 16, 1985

[54] DEVICE FOR STARTING AND OPERATING GAS DISCHARGE TUBES

[75] Inventor: LeRoy D. Barter, Fullerton, Calif.

[73] Assignee: Beckman Instruments, Inc., Fullerton, Calif.

[21] Appl. No.: 509,904

[22] Filed: Jun. 30, 1983

[51] Int. Cl.[3] ..... H05B 37/02; G05F 1/00

[52] U.S. Cl. ..... 315/308; 315/220; 315/226; 315/287; 315/307; 315/DIG. 2; 315/DIG. 7

[58] Field of Search ..... 315/308, 307, 219, 220, 315/226, 287, DIG. 2, DIG.7

[56] References Cited

U.S. PATENT DOCUMENTS

| | | | |
|---|---|---|---|
| 3,449,629 | 6/1969 | Wigert et al. | 315/308 |
| 3,689,827 | 9/1972 | Quinn | 315/308 |
| 3,710,177 | 1/1973 | Ward | 315/DIG. 2 |
| 4,060,752 | 11/1977 | Walker | 315/244 |

*Primary Examiner*—Harold Dixon

*Attorney, Agent, or Firm*—W. H. May; R. R. Meads; G. T. Hampson

[57] ABSTRACT

A device for starting and operating gas discharge tubes including a DC-to-AC inverter which generates a low voltage or a high voltage at an output thereof in response to first or second input signals, respectively. The output of the inverter is connected to a gas discharge tube and sensing means generates a signal proportional to the current flow through the tube. Suitable means provides a trigger or synchronizing signal to a driver. The driver, responsive to the sensed output signal and the trigger or synchronizing signal, generates a drive signal synchronized with the trigger or synchronizing signal and having a duration inversely related to the magnitude of the current flowing through the gas discharge tube. A high voltage switch applies a second input signal to the inverter in response to the drive signal to provide a decreasing high voltage duration during successive cycles of the inverter as the tube begins to conduct current. The device further includes a first input signal source which applies the low voltage input signal to the inverter such that the inverter provides low voltage to the tube when the drive signal is not present.

4 Claims, 2 Drawing Figures

-10-
FROM D.C. POWER SOURCE
16
LOW VOLTAGE REGULATOR
14
HIGH VOLTAGE SWITCH
20
18
D.C. INVERTER
12
GAS DISCHARGE TUBE
22
CURRENT SENSOR
24
COMPARATOR
26
TRIGGER GENERATOR
SYNCHRONIZER
28
27
RAMP GENERATOR
30

DEVICE FOR STARTING AND OPERATING GAS DISCHARGE TUBES

FIELD OF THE INVENTION

The present invention relates generally to the field of gas discharge tubes and in particular to a device for starting and running gas discharge tubes.

BACKGROUND OF THE INVENTION

Various types of gas discharge tubes are known for providing light in the visible and invisible portions of the electromagnetic spectrum. Generally, a gas discharge tube requires a high voltage during a starting phase to initially ionize or excite gas molecules within the tube and, once a plasma of ionized gas molecules is created, a lower voltage to run the tube.

One form of device for starting and running gas discharge tubes is a regulating transformer, such as a model number SCT-1 available from Ultra-Violte Products, Inc. A regulating transformer provides an initial high starting voltage to ignite the tube and a lower tube running voltage. However, such transformers have several disadvantages. They are often large and heavy, produce radio frequency interference (RFI) which may be difficult to shield or otherwise isolate, and generate excessive heat.

In an effort to overcome the disadvantage associated with such transformers, it is known to use a DC inverter to provide AC starting and running voltages to a gas discharge tube. Such an inverter includes a transformer having primary and secondary windings and is self oscillating such that the input DC current is conducted in an alternating fashion through the transformer primary winding. As is well known, the ratio of the number of turns on the transformer primary winding to the number of turns in the transformer secondary winding is proportional to the voltage step-up or step-down produced by the transformer.

Prior DC inverters used to operate a gas discharge tube develop a high AC starting voltage by applying input DC current to a first tap on the primary winding of the transformer connected to provide a high voltage step-up. The input DC current is applied for a predetermined time during which the tube ignites. After the predetermined time, the input DC current is applied to a second tap on the transformer primary winding, the second tap providing a lower voltage step-up and thus providing a lower AC running voltage for the tube.

Although such DC inverters are generally more efficient than a transformer, and thus generate less operating heat, can be better shielded to prevent RFI and can be adapted to fit where a transformer may not be used, such inverters can draw high undesirably input DC currents during the predetermined high voltage output time since the tube is partially conductive during at least a portion of such time. Thus, the high current demand required to start the tube requires that the converter include heavier transformer windings, transistors with higher current ratings and other components suitable for high current flow through the inverter. Moreover, such high current flow produces unwanted heat and requires that the power supply providing input DC current for the inverter be capable of supplying high currents during the starting phase of tube operation.

Thus, there is a need for a device for starting and running gas discharge tubes which does not require large currents during the tube starting phase, consequently decreasing the need for a large input DC power supply and allowing the use of components with lower current ratings. Moreover, there is a need for a tube starting and running device which dissipates less heat during the tube starting phase than prior inverter devices.

SUMMARY OF THE INVENTION

A device in accordance with the present invention overcomes the limitations described above by reducing current demand from the device power supply, reducing heat dissipated by the device, and enabling the device to be constructed with components having lower current ratings.

Toward the foregoing ends, a device in accordance with the present invention includes an inverter which generates a low voltage or high voltage at an output thereof in response to first or second input signals, respectively. The output of the inverter is connected to a gas discharge tube. Sensing means generates a signal proportional to the current flow through the gas discharge tube. The device includes means for periodically generating a trigger signal. A driver, responsive to the sensed output signal and the trigger signal, generates a drive signal synchronized with the trigger signal and having a duration inversely related to the magnitude of the current flowing through the gas discharge tube. A high voltage switch applies the second input signal to the inverter in response to the drive signal. The device further includes a first input signal source which applies the first signal to the inverter such that the inverter provides low voltage to the tube when the drive signal is not present.

In the embodiment disclosed herein, the driver includes means for generating a ramp signal in response to the synchronizing signal and a comparator for comparing the ramp signal and the sensed output signal. The comparator generates the drive signal when the ramp signal is in a predetermined relationship with the sensed output signal. Furthermore, the device may include synchronizing means, responsive to the inverter, to generate the trigger signal in response to current flow direction changes in the inverter.

DETAILED DESCRIPTION

Figure 1:
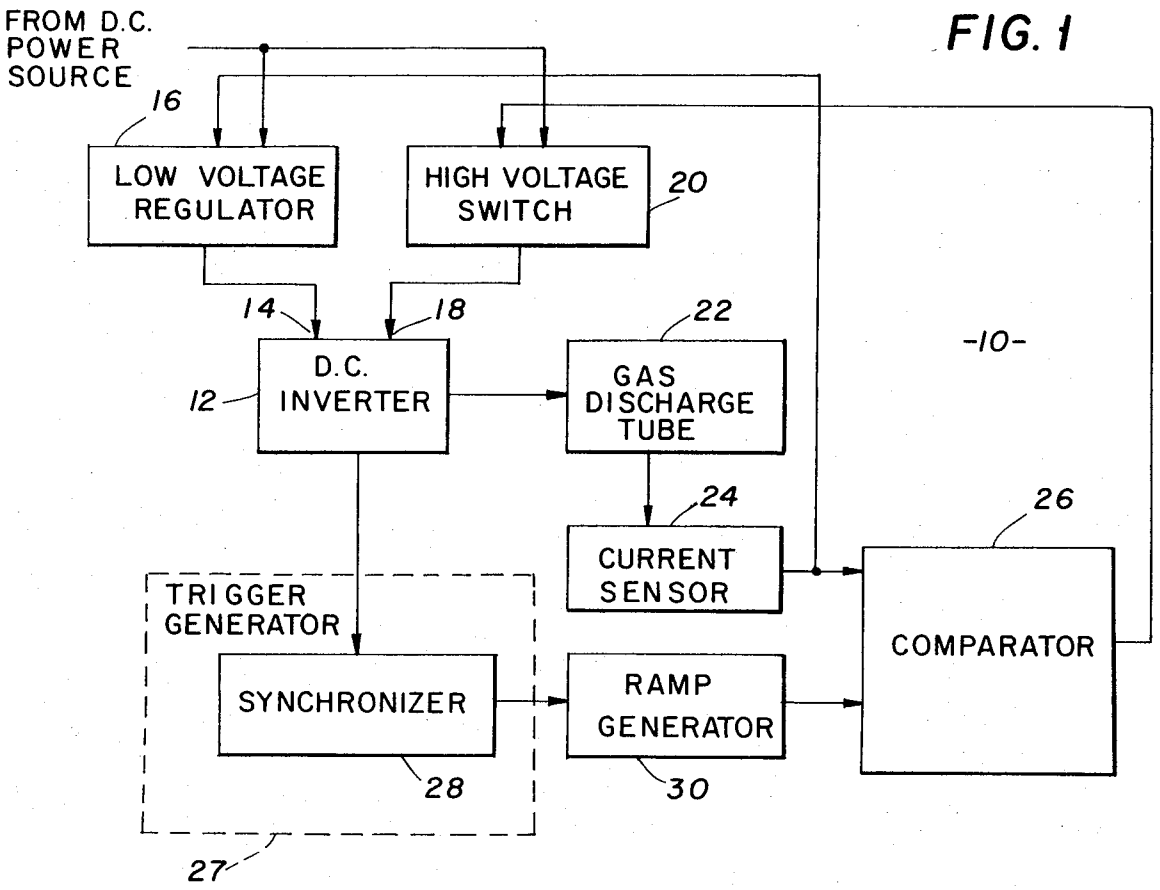
FIG. 1 is a block diagram of a device in accordance with the present invention.

With reference to FIG. 1, a device 10 in accordance with the present invention includes a DC inverter 12. The DC inverter 12 includes a first input 14 which receives input DC power from a low voltage regulator 16. The inverter 12 also includes a second input 18 which receives input DC power from a high voltage switch 20.

The DC inverter 12 generates an alternating current (AC) output which is applied to a gas discharge tube 22. A current sensor 24 is responsive to the current flowing through the gas discharge tube 22 and provides an output proportional to such current to the low voltage regulator 16 and a first input of a comparator 26.

A trigger generator 27 periodically generates a trigger or synchronizing signal. The period of the trigger or synchronizing signal is less than the cooling time constant of the tube 22. In the embodiment disclosed herein, the trigger generator 27 includes a synchronizer 28 which is responsive to changes in current direction within the DC inverter 12 and, which provides the trigger or synchronizing signal synchronized therewith to a ramp generator 30. In response to the synchronizing signal from the synchronizer 28, the ramp generator 30 generates a ramping or varying signal which is applied to a second input of the comparator 26. The comparator 26 compares the ramp signal from the ramp generator 30 with the current signal from the current sensor 24 and provides a drive signal output to the high voltage switch 20 when the ramp signal and the current signal are in a predetermined relationship. In response to the drive signal, the high voltage switch 30 applies DC power from a DC power source to the second input 18 of the DC inverter 12. The low voltage regulator 16 provides a regulated DC input to the first input 14 of the DC inverter 12 in accordance with the current signal generated by the current sensor 24.

In operation, the DC inverter 12 is self-oscillating, generating the output AC power for the gas discharge tube 22 in response to DC input power applied to the first and second inputs 14 and 18. In particular, with DC input power applied only from the low voltage regulator to the first input 14, the DC inverter oscillates and generates a low voltage output in the range of about 200 volts which is applied to the gas discharge tube 22. Each complete oscillation of the DC inverter 12 represents a complete cycle of inverter operation, each cycle including a first portion and a second portion defined by a switching of DC current flow in the DC inverter 12. Each cycle of the inverter 12 generates a corresponding AC output voltage cycle.

If the high voltage switch 20 is enabled by the drive signal from the comparator 26, the high voltage switch 20 applies DC power to the second input 18 of the DC inverter 12. As will be described more fully with reference to FIG. 2, the DC inverter 12 generates a high voltage output during the portion of the inverter cycle that DC input power is applied to the second input 18 from the switch 20. When DC power is removed from the second input 18, the DC inverter 12 reverts to the low voltage output in response to the DC power applied to the first input 14.

With the tube 22 in an off or nonconductive condition and with DC power applied to the low voltage regulator and the high voltage switch 20, the DC inverter 12 oscillates. The synchronizer 28 detects the oscillations within the DC inverter 12 and provides an output at the beginning of each inverter cycle. With each synchronizing signal from the synchronizer 28, the ramp generator 30 initiates a ramp signal that is applied to the comparator 26.

With each cycle of the DC inverter 12, the output of the ramp generator 30 is compared with the output of the current sensor 24 by the comparator 26. With the tube initially off or nonconductive, the current signal from the current sensor 24 is less than the ramp signal throughout the duration of the ramp signal and consequently the comparator 26 provides a drive signal output to the high voltage switch 20 during the duration of the ramp signal. In response thereto, the high voltage switch 20 applies DC power to the second input 18, controlling the DC inverter 12 to apply a high voltage AC output to the gas discharge tube 14.

The gas discharge tube 14 essentially immediately begins to conduct current. As the tube current increases, the comparator 26 in response to the current sensor output and the ramp signal generates a drive signal of decreasing duration during each inverter cycle which is applied to the high voltage switch 20. Consequently, the high voltage switch 20 applies DC power to the second input 18 for correspondingly decreasing durations during each DC inverter cycle thereby decreasing the high voltage applied to the gas discharge tube 14. Once the gas discharge tube 26 current reaches a predetermined level indicating that the lamp is operating, the comparator 26 no longer provides drive input signals to the high voltage switch 20 and the AC output voltage of the DC inverter 12 is controlled only by means of DC power applied to the first input 14 from the low voltage regulator 16.

Thus, by modulating or varying the duration of the DC power applied to the second input 18 during tube 22 start-up, the AC output from the DC inverter 12 is accordingly varied from a high voltage level to a low voltage level. Because the duration of the DC power from the high voltage switch 20 decreases as the current through the gas discharge tube 22 increases, the current from the DC power source does not reach excessive magnitudes during the start phase of the gas discharge tube 22. Thus, the device 10 decreases the duration that high voltage is applied to the gas discharge tube 22 during each inverter 12 cycle in accordance with a current flowing through the tube 22, minimizing the current required from the DC power source, limiting the power dissipated by the device 10, and allowing components having lower current carrying capabilities to be used in the device 10.

Figure 2:
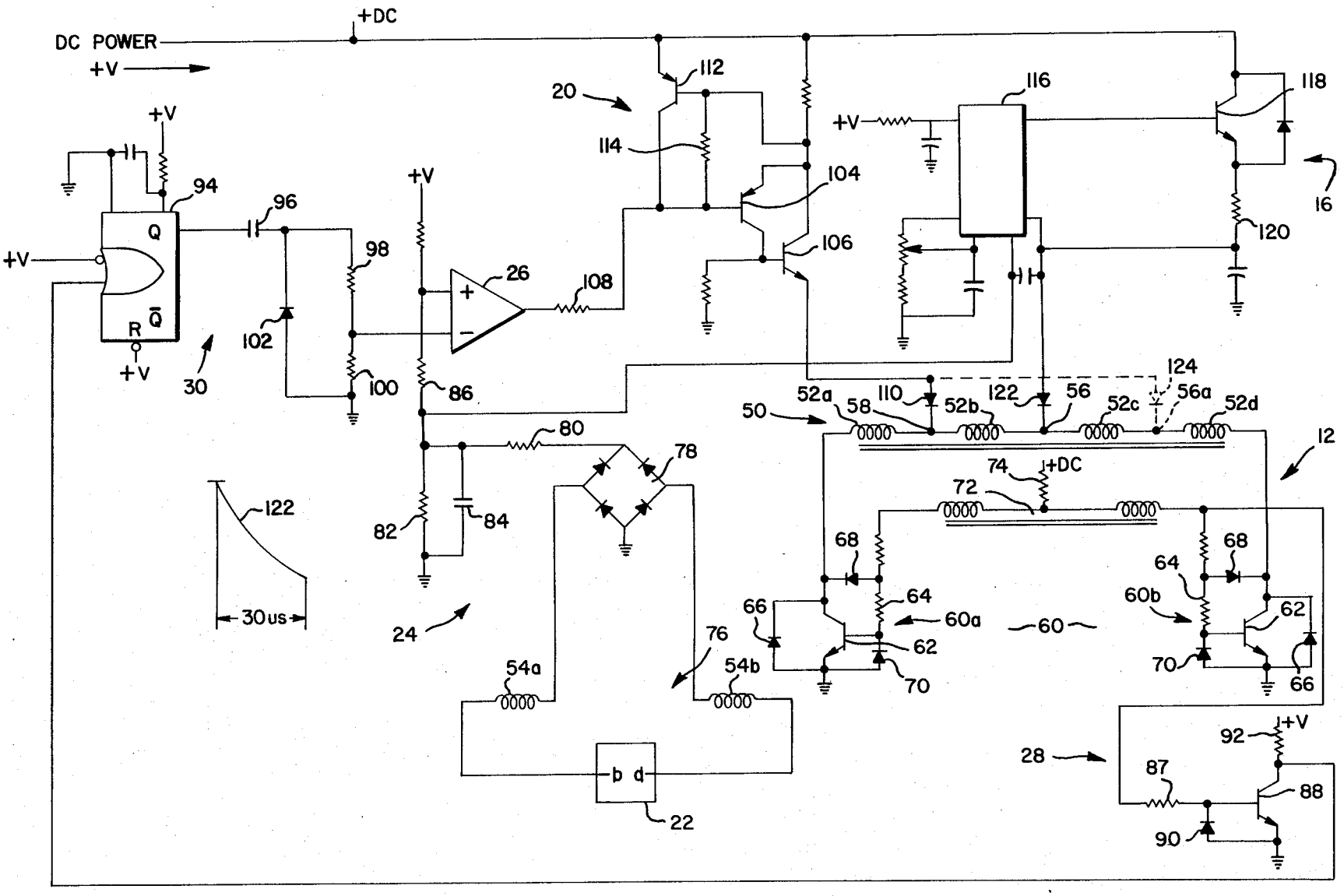
FIG. 2 is a simplified schematic diagram of the device of FIG. 1.

With reference now to FIG. 2, the DC inverter 12 includes a transformer 50 which in turn comprises series primary windings **52*a*–52*d* and secondary windings 54*a* and 54*b*. In a first embodiment, the primary windings 52*a*–52*b* include a first tap 56 between the windings 52*b* and 52*c* and a second tap 58 between the windings 52*a* and 52*b*. The first and second taps 56 and 58 correspond to the first and second inputs 14 and 18 of FIG. 1, respectively. The winding 52*a* is connected to a first half 60*a* of a conventional inverter drive circuit 60. The first half 60*a* and a second half 60*b* of the circuit 60 each comprise indentical transistors 62, resistors 64 and diodes 66, 68 and 70. The drive circuit 60, along with a winding 72 connected between the halves 60*a* and 60*b* form an oscillator which alternatingly conducts DC current through portions of the primary windings 52*a*–52*d* to thereby induce in the secondary windings 54*a* and 54*b* alternating current having a voltage proportional to the primary-to-secondary turns ratio as is well known in the art. A resistor 74 connected between +V and the winding 72 is used to initally induce oscillations in the inverter 12**. DC inverters of the type used herein are described, for example, in RCA Power Circuit, copyright 1969, beginning at page 162.

The gas discharge tube 22 is part of a gas discharge tube circuit 76 comprising the tube 22 connected in series with the secondary windings **54*a* and 54*b*. The windings 54*a* and 54*b* are in turn connected to a bridge rectifier 78 within the current sensor 24. The output of the bridge rectifier 78 is connected across a voltage divider formed by resistors 80 and 82. A capacitor 84 is connected in parallel with the resistor 82**.

The output of the current sensor 24 is developed at the connection point of the resistors 80 and 82 and the capacitor 84. The output is applied through a resistor 86 to the non-inverting input of the comparator 26. The output of the current sensor 24 is also applied to a conventional voltage regulator 116 such as a type μA723C. The voltage regulator 116 is connected in a conventional fashion and drives the base of a transistor 118, the collector of which is connected to DC power. The emitter of the transistor 118 is connected through a resistor 120 and a diode 122 to the tap 56, thereby providing a first drive signal to the DC inverter 12.

The synchronizer 28 comprises a resistor 87, a transistor 88, a diode 90 and a resistor 92 connected so as to provide an output at the collector of transistor 88 synchronized with the operation of the drive circuit 60. Specifically, the generator 22 provides a +V output during the time that current flows through the first half 60*a* of the driver 60 and a zero volt output during the time that current flows through the second half 60*b*.

The output from the synchronizer 28 is applied to the ramp generator 30 to trigger a monostable multivibrator 94 connected in a conventional fashion. The monostable multivibrator 94 may be, for example a type 74LS123. The output of the multivibrator 94 is applied through a capacitor 96, a resistor 98 and a resistor 100, all connected in series, to ground. A diode 102 is connected in parallel with the series combination of resistors 98 and 100. The node between the resistors 98 and 100 is connected to the inverting input of the comparator 26.

The output of the comparator 26 is connected through a resistor 108 to the base of a transistor 104, part of the high voltage switch 20. In response to low voltage output from the comparator 26, the transistor 104 along with a transistor 106 provide DC current through a diode 110 to the tap 58, thereby providing a high voltage drive signal to the inverter 12. A transistor 112 and resistor 114 act as current limiters, protecting the transistors 104 and 106.

In operation, the inverter drive circuit 60 alternatingly switches the portions 52*a* and 52*d* and the portions 52*c* and 52*d* of the primary winding to ground through the left and right halves 60*a* and 60*b* of the circuit 60. If no DC power is applied through the switch 20 by the transistors 104 and 106 to the diode 110, then DC power is applied only through the low voltage regulator 16 via the transistor 118, resistor 120, and diode 122 to the tap 56. DC current flows in an alternating fashion through the windings 52*b* and 52*a* and the first half 60*a* to ground and then the windings 52*c* and 52*d* and the portion 60*b* to ground. Because of the ratio of turns between the combined primary windings 52*b* and 52*a* with respect to the secondary windings 54*a* and 54*b*, the inverter 12 produces a low AC voltage across the tube 22.

However, if the comparator 26 controls the transistors 104 and 106 so as to provide DC power through the diode 110, during the portion of the inverter cycle wherein the first half 60*a* of the circuit 60 conducts, DC current will be drawn through the diode 110 and the winding 52*a*. The turns ratio of the primary winding 52*a* to the secondary 54*a* and 54*b* is substantially greater than the ratio of the primary windings 52*a* and 52*b*, combined, with respect to the secondary windings 54*a* and 54*b*. Consequently, with current supplied through the winding 52*a*, the output voltage of the inverter 12 appearing across the tube 22 is high. In the embodiment disclosed herein, the peak high voltage which may appear across the tube 22 produced as just described is in the range of 1000 to 2000 volts.

Once the inverter drive circuit 60 switches such that the right half 60*b* conducts, DC current will then be drawn through the low voltage regulator 16 and the diode 122, producing a low voltage output for the second portion of the inverter cycle across the tube 22.

It will be noted that if the DC power from the high voltage switch 20 is terminated before the end of the first portion of the inverter cycle, DC power from the low voltage regulator 16 will flow through the diode 122 and through primary windings 52*a* and 52*b*. Consequently, during the remainder of the first portion of the inverter cycle, low voltage will appear across the tube 22.

With respect now to the overall operation of the device 10 as shown in FIG. 2, the transistor 88 of the synchronizer 28 is turned off when current flows through the first half 60*a*. In response to the +V output at the collector of the transistor 88, the monostable multivibrator 94 is triggered. The output of the multivibrator 94, through the capacitor 96 and the resistors 98 and 100, develops a ramp signal 122 which is applied to the comparator 20. In the embodiment disclosed herein, the ramp signal 122 has a duration of approximately 30 microseconds and ranges from approximately 5 V to 2 V. Thus, at the beginning of the first portion of each cycle of the inverter 12, the ramp signal 122 is applied to the comparator 20.

With the tube 22 initially extinguished and non-conductive, the output developed by the current sensor 24 across the resistor 82 is less than the ramp signal 122 applied to the comparator 26. Consequently, the output of the comparator 26 is near zero volts with respect to circuit ground during the entire duration of the ramp signal 122. A near zero volt output of the comparator 26 turns on the transistors 104 and 106, applying DC power through the diode 110 to the tap 58 as described above, resulting in the inverter 12 applying high voltage to the tube 22 during the first portion of the inverter cycle and applying low voltage to the tube 22 during the second portion of the inverter cycle.

As the inverter 12 continues to oscillate and the tube 22 begins to conduct in response to the high voltage applied thereto, current begins to flow through the bridge 78 and the resistors 80 and 82. During of each cycle of the inverter 12, the voltage across the resistor 82 is compared to the ramp signal 122 which, as described above, is synchronized with the beginning of the first portion of the inverter cycle. With a small amount of current flowing through the tube 22, the voltage across the resistor 82 as compared to the ramp 182 will cause the comparator 26 to control the switch 20 to apply DC power through the diode 110 until the level of the ramp signal 122 is less than the voltage across the resistor 82. During such time, the inverter 12 applies high voltage to the tube 22. Once the ramp signal 122 becomes less than the voltage across the resistor 82, current flow through the high voltage switch 20 is terminated and the inverter 12 applies low voltage to the tube 22 during the remainder of the first portion and during the second portion of the inverter cycle.

As the tube 22 becomes increasingly conductive, more current flows through the bridge 78 and the resistors 80 and 82. Accordingly, the voltage across the resistor 82 increases and the duration of the first portion of the inverter 12 cycle during which high voltage is applied to the tube 22 correspondingly decreases. The high voltage continues to decrease as the lamp current continues to increase until the current through the lamp 22 is sufficient to inactive the comparator 26, whereupon the inverter 22 runs in the low-voltage mode with current supplied only from the low voltage regulator 16 via the diode 122. The low voltage regulator 16, in response to the signal from the current sensor 24, regulates the DC power applied to the tap 56 so as the maintain tube 22 current flow at a desired operating point during low voltage operation thereof.

Thus it is seen that the inverter of the present invention gradually starts the tube 76 and brings the tube 76 to an operating point whereupon only low voltage is required to continue the operation of the tube 76. Advantageously, the length of time that high voltage is applied to the tube 76 during each cycle of the inverter 22 is descreased as the current through the tube 76 increases, thereby minimizing the maximum current through the device 10 during tube start up. Because the current through the device 10 is not maintained at a high level during tube 76 start up, the components in the inverter 22 may be designed and selected to have lower current carrying capabilities and less heat will be dissipated by the device 10.

In an alternate embodiment of the present invention, the anode of an additional diode 124 is connected to the anode of the diode 110 and thus to the high voltage switch 20. The cathode of the diode 124 is connected to a third tap 58*a* on the primary winding of the transformer 50. The tap 58*a* is selected such that the primary-to-secondary turns ratio of the winding 52*d* to the secondary windings 54*a* and 54*b* is the same as the ratio for the primary winding 52*a* to the secondary windings 54*a* and 54*b*. Consequently, high voltage drive current may be applied by the high voltage switch 25 during both of the first and second portions of the inverter cycle. The operation of the alternate embodiment is otherwise substantially as just described, that is, as the current through the tube 22 increases, the high voltage duration decreases during the first and second portion of each inverter cycle, decreasing the duration that high voltage is applied to the tube 22 as the current through the tube 22 increases.

Although the present invention has been described with respect to sensing current through the tube 22, it will be recognized that tube temperature or light output may also be used to control the high voltage supplied to the tube 22 during start up.

While several embodiments of the present invention have been illustrated and described, it will be understood that various modifications may be made therein without departing from the subject and scope of the appended claims.

What is claimed is:

1. A device for supplying starting and running power to a gas discharge tube, comprising:

an inverter having means for generating a low voltage or a high voltage at an output thereof in response to first or second input signals, respectively, the output being connected to the gas discharge tube;

sensing means for providing a sensed output signal proportional to current flow through the gas discharge tube;

means for periodically generating a trigger signal;

driver means responsive to the sensed output signal and the trigger signal for generating a drive signal synchronized with the trigger signal and having a duration inversely related to the magnitude of the current flowing through the gas discharge tube;

switch means for applying the second input signal to the inverter in response to the drive signal; and means for applying the first input signal to the inverter.

2. A device as in claim 1, wherein the driver means comprises:

generator means for generating a ramp signal in response to the trigger signal; and comparator means for comparing the ramp signal and the sensed output signal and for providing the drive signal when the ramp signal is in a predetermined relationship with the sensed output signal.

3. A device as in claim 2 wherein the mans for generating the trigger signal includes synchronizing means responsive to the inverter for providing the trigger signal in response to current flow direction changes in the inverter.

4. A device for supplying, starting and running power to a gas discharge tube, comprising:

an inverter having means for generating a low voltage or a high voltage at an output thereof in response to first or second input signals, respectively, the output being connected to the gas discharge tube;

sensing means for providing a sensed output signals proportional to current flow through the gas discharge tube;

synchronizing means responsive to the inverter for providing a synchronizing signal in response to current flow direction changes in the inverter;

generator means for generating a ramp signal in response to the synchronizing signal;

comparator means for comparing the ramp signal and the sensed output signal and for providing a drive signal when the ramp signal is in a predetermined relationship with the sensed output signal;

switch means for applying the second input signal to the inverter in response to the drive signal; and a low voltage regultor responsive to the sensed output signal for applying the first input signal to the inverter in proportional to the sensed output signal.

* * * * *